US010041221B2

(12) United States Patent
Wu

(10) Patent No.: US 10,041,221 B2
(45) Date of Patent: Aug. 7, 2018

(54) STEEL PLATE AND CONCRETE COMPOSITE TANK UNIT, TANK GROUP AND OFFSHORE PLATFORMS

(71) Applicant: Zhirong Wu, Beijing (CN)

(72) Inventor: Zhirong Wu, Beijing (CN)

( * ) Notice: Subject to any disclaimer, the term of this patent is extended or adjusted under 35 U.S.C. 154(b) by 320 days.

(21) Appl. No.: 14/805,398

(22) Filed: Jul. 21, 2015

(65) Prior Publication Data

US 2015/0321838 A1 Nov. 12, 2015

Related U.S. Application Data

(63) Continuation of application No. PCT/CN2013/070808, filed on Jan. 22, 2013.

(51) Int. Cl.
*E04H 7/18* (2006.01)
*E02B 17/02* (2006.01)
(Continued)

(52) U.S. Cl.
CPC ..... *E02B 17/02* (2013.01); *B63B 35/4413* (2013.01); *B65D 88/02* (2013.01); *E02B 17/0017* (2013.01); *E02B 17/025* (2013.01); *E02B 17/027* (2013.01); *E02B 17/08* (2013.01); *E02D 23/02* (2013.01); *E02D 23/10* (2013.01); *E02D 25/00* (2013.01); *E02D 27/12* (2013.01); *E02D 27/18* (2013.01); *E02D 27/20* (2013.01); *E02D 27/38* (2013.01); *E02D 27/52* (2013.01); *E02D 27/525* (2013.01); *E02D 29/00* (2013.01); *E02D 29/06* (2013.01); *E04H 7/02* (2013.01); *E04H 7/04* (2013.01); *E04H 7/18* (2013.01); *B63B 35/44* (2013.01); *B63B 2035/442* (2013.01); *B63B 2035/448* (2013.01);
(Continued)

(58) Field of Classification Search
CPC .. B65D 88/78; E04H 7/02; E04H 7/04; E04H 7/06; E04H 7/065; E04H 7/16; E04H 7/18
USPC ..... 405/210; 114/256, 257; 220/567.2, 220/560.1, 651, 652, 654, 901
See application file for complete search history.

(56) References Cited

U.S. PATENT DOCUMENTS 3,537,268 A 11/1970 Georgii
3,630,161 A 12/1971 Georgii
(Continued)

FOREIGN PATENT DOCUMENTS

CN 101148951 A 3/2008
CN 101544272 A 9/2009
DE 3229576 A1 * 3/1984

OTHER PUBLICATIONS

International Search Report issued for PCT/CN2013/070808, dated Oct. 31, 2013, 6 pages.

*Primary Examiner* — Sunil Singh
(74) *Attorney, Agent, or Firm* — Norton Rose Fulbright US LLP

(57) ABSTRACT

A steel plate and concrete composite tank unit, tank groups and offshore platforms with new type of tank units are disclosed. The tank unit comprises an outer concrete tank that comprises an outer tank shell, two heads and ring shell connections at both ends, an inner steel tank that comprises an inner tank shell, epitaxial structures at both ends of the inner steel tank. Inner tank shell is connected to the outer tank shell by epitaxial structures, and an isolation layer that is formed from the gap between the outer concrete tank and the inner steel tank where it is filled with isolation medium.

19 Claims, 5 Drawing Sheets

Detailed B

(51) Int. Cl.

| | |
|---|---|
| ***E02D 27/20*** | (2006.01) |
| ***E02D 23/02*** | (2006.01) |
| ***E02D 23/10*** | (2006.01) |
| ***E02D 25/00*** | (2006.01) |
| ***E02D 27/18*** | (2006.01) |
| ***E02D 27/52*** | (2006.01) |
| ***E02D 29/09*** | (2006.01) |
| ***E04H 7/02*** | (2006.01) |
| ***B63B 35/44*** | (2006.01) |
| ***E02B 17/08*** | (2006.01) |
| ***B65D 88/02*** | (2006.01) |
| ***E04H 7/04*** | (2006.01) |
| ***E02D 27/12*** | (2006.01) |
| ***E02D 27/38*** | (2006.01) |
| ***E02D 29/00*** | (2006.01) |
| *E02B 17/00* | (2006.01) |
| *B65D 88/78* | (2006.01) |

(52) U.S. Cl.

CPC ..... *B65D 88/78* (2013.01); *E02B 2017/0039* (2013.01); *E02B 2017/0043* (2013.01); *E02B 2017/0056* (2013.01); *E02B 2017/0069* (2013.01); *F17C 2201/0104* (2013.01); *F17C 2201/054* (2013.01); *F17C 2203/0341* (2013.01); *F17C 2203/0362* (2013.01); *F17C 2203/0379* (2013.01); *F17C 2203/0631* (2013.01); *F17C 2203/0639* (2013.01); *F17C 2203/0678* (2013.01); *F17C 2205/0111* (2013.01); *F17C 2221/033* (2013.01); *F17C 2221/035* (2013.01); *F17C 2223/0153* (2013.01); *F17C 2223/0161* (2013.01); *F17C 2223/033* (2013.01)

(56) References Cited

U.S. PATENT DOCUMENTS 3,870,003 A * 3/1975 Mo ..... B63B 35/4413 405/203
4,087,984 A * 5/1978 Mo ..... E02B 17/025 405/207
2007/0140795 A1 6/2007 Espinasse

* cited by examiner

Detailed B

Detailed C

Detailed D

Detailed E

Detailed F

STEEL PLATE AND CONCRETE COMPOSITE TANK UNIT, TANK GROUP AND OFFSHORE PLATFORMS

CROSS-REFERENCE TO RELATED APPLICATIONS

This application is a continuation of International Patent Application Serial No. PCT/CN2013/070808 entitled "Unitary Barrel of Steel Plate and Concrete Composite Structure, Unitary Group Barrel, and Offshore Platform," filed on Jan. 22, 2013, which is incorporated herein by reference in its entirety.

BACKGROUND

Field of the Invention

This application offers a new type of storage tank. The storage tank is a steel plate and concrete composite structure (tank unit and tank group) used for storing industrial liquid products below the sea waterline, such as crude oil, refined oil, LNG (liquefied natural gas), LPG (liquefied petroleum gas), and so on. In addition, the composite tank group would be used as a foundation to support offshore storage, drilling and production facilities.

Background of the Invention

As well known, the compressive strength of a concrete structure is much greater than the tensile strength. As a result, concrete tank is suitable to be external pressured rather than internal pressured. Currently, concrete construction technologies being used for internal pressure tanks are mainly: prestressed concrete structure and double steel-plate concrete structure (BI-STEEL). Based on theories, the two existing schemes for concrete internal pressure tanks are mature technologies. However, in order to resist the tensile stress in the tank wall caused by the internal pressure, a lot of special techniques are required. This causes plenty of challenges on the design and construction of concrete tanks and significantly increases the difficulty and complexity in construction work, construction period and cost.

SUMMARY OF THE INVENTION

One object of this application is to provide a type of steel plate and concrete composite tank unit that has the advantages of high tensile and compressive resistance, high structural strength, little construction challenge and complexity, short construction duration, low cost and easy maintenance.

Another object of the present application is to provide a type of tank group based on multiple tank units as described in Applicant's U.S. Pat. Nos. 8,292,546 and 8,678,711, which are incorporated by reference herein, with the purpose of storing industrial liquids in an offshore environment.

The further object of this application is to provide a type of offshore platform that could be used for oil and gas field development, drilling, oil and natural gas production, natural gas liquefaction, natural gas chemical industry and liquid storage.

To accomplish the above objects, the present application proposes a type of steel plate and concrete composite tank unit comprising following components: 1) an outer concrete tank, which is composed of an outer tank shell, two heads and two connections at both ends; 2) an inner steel tank inside the outer concrete tank, which is composed of an inner tank shell, two arched heads and two epitaxial structure at both ends; the inner tank shell is connected to the outer tank connections through the epitaxial structures; 3) isolation layer, which is the gap between the outer tank and the inner tank, where some isolation medium is filled in.

For the tank unit described above, one end of the epitaxial structure of the inner steel tank is fixed onto one of the connections of the outer concrete tank, to form a fixing connection; the other end of the epitaxial structure is inset into the other one of the connections of the outer concrete tank to form a sliding connection, so the inner steel tank could slide in the outer concrete tank along the central axis; the outer concrete tank, the inner steel tank and the isolation layer build as an integrated structure through the fixing and the sliding connections.

For the tank unit as described above, the epitaxial structure of the inner steel tank has two forms: cylinder epitaxial structure and leg epitaxial structure which are formed by extending both ends of the shell body respectively.

For the tank unit as described above, the inner steel tank is combined with at least one pair of compartments for liquid storage and seawater ballast respectively in a symmetrical form as a combined tank, or is only containing a liquid storage compartment without seawater ballast compartment; the liquid storage compartment and the seawater ballast compartment in the combined tank are arranged in vertically or horizontally end-to-end or pot-in-pot positions; the surface of the inner steel tank which contacts corrosive liquids such as seawater, oil and other liquids, is coated with protective coating.

For the tank unit as described above, said liquid storage compartment is used to store various industrial liquids, such as crude oil, refined oil, LPG, LNG and so on; the liquid storage compartment wall is single-wall made of steel or multi-wall and the multi-wall for storing low-temperature liquids like LNG is built in three layers from inside to outside, i.e., an inner alloy steel plate with ultra-low temperature resistance and low coefficient of linear expansion, an insulation material layer and an outer layer of steel plate.

For the tank unit as described above, the medium in the isolation layer is an inert gas, or a liquid, or an inert gas with soft solid material, or a liquid with soft solid material, which main function is to avoid or reduce the probability of strain and stress being directly transferred between the inner steel tank and the outer concrete tank; the system pressure of the isolation medium need to be set as per the external pressures acting on the outer concrete tank and the internal pressures acting on the inner steel tank, that is to reduce the pressures acting on the outer concrete tank and the inner steel tank; and the system pressure of isolation medium could be controlled and safely released.

This application also provides a tank group for storing offshore industrial liquids. The tank group consists of one or more tank units that are closely connected in parallel or in series by connections; the top of tank group is submerged in the water or above the waterline, the tank units in the tank group are arranged vertically to become a vertical tank group or arranged horizontally to become a horizontal tank group.

For the tank group as described above, at least two tank units are closely joined in parallel by group connections and arranged vertically to become a vertical and parallel tank group; the vertical parallel tank group consists of a body and a skirt bottom compartment attached to the lower portion of the body; the body consists of at least two tank units that are joined together by the group connection structure and closely arranged in honeycomb upright, and the skirt bottom compartment with rectangular section is submerged in the water, embracing lower part of the body or attached at both lower sides of the body; the bottoms of the skirt bottom compartment and the body are in a same horizontal plane, the internal space of the skirt bottom compartment could be divided into one or more sub-compartments for liquid storage, seawater ballast, and/or fixed ballast; the function of the skirt bottom compartment is to increase buoyancy during construction and towing, to adjust the center of gravity and increase self-weight, to increase added mass and damping of the floating tank group so as to improve its hydrodynamic performance, and to reduce the seabed erosion of a fixed tank group.

For the tank group as described above, which is a floating tank group being secured to the seabed by mooring legs, or is a fixed tank group being sit and fixed on a seabed by a suction piles foundation, or a long piles foundation, or a gravity foundation, or the pile with gravity foundation.

For the tank group as described above, the long pile is a sealing steel pile comprising a tubular pipe and a top head which are welded together, and a release valve, an air intake valve and an water intake valve installed on the head; each sealing steel pile is inserted into one of pile sleeves of the tank group and temporarily fixed onto the tank group before towing; the sealing steel pile is pressed into a seafloor by the self-weight of tank group after ballasting during offshore installation; the installation steps are following: 1) towing the tank group to the sea site then locating and positioning, opening the release valve, releasing the temporary fixed connection on piles, pressing long piles into the mud by the self-weight of piles, 2) temporarily fixing the sealing steel pile onto the tank group again, ballasting seawater to the tank group to make it sink and press pile, meanwhile, attentions are required on timely adjusting the quantity of ballast water in different orientations depending on the level of the tank group, 3) if more times of pressing pile is required, releasing the temporary fixing connection on piles after the tank group reaches the seabed; draining away the ballast water to make the tank group float again, 4) repeating the steps of pressing piles—floating—pressing piles again until the pile reaches the design depth below the mud-line, making the tank group sit on the seabed, then connecting and fixing the pile onto tank group finally, 5) injecting water through the water intake valve and exhausting the air, then closing all the three valves after water is full, discharging redundant ballast water in the tank group to complete the offshore installation; the sealing steel pile could be pulling up by draining and floating the tank group, the steps of pulling pile are following: 1) draining away the water and the ballast inside the tank group to make it loaded lightly, opening all release valves to make the tank group float and to start the process of pulling piles up, 2) when the tank group floats up to water surface but the piles not out of the seabed and more times of pulling pile is required, removing the fixing connections on the pile after injecting water into the pile fully and closing all valves, the water column inside the sealing steel pile could avoid the long pile sink by self-weight, 3) ballasting water into the tank group to make it sink to the seabed again, temporarily fixing the sealing steel pile onto the tank group again, 4) starting the second time, or maybe the third time of pulling process and repeating the said steps again until the piles out of the mud-line, 5) connecting the piles to the tank group to complete the process of pulling piles; as an additional measure to pull the pile, air or water could be injected into the sealing steel pile through the intake valves to increase pulling-up force on the pile.

Also, this application offers a type of offshore platforms for the development of offshore oil and gas fields, drilling, oil and natural gas production, natural gas liquefaction, natural gas chemical industry and liquid storage, the offshore platform includes: 1) one or more the said tank group(s) for storing the platform produced liquids with or without a transparent moon pool, and the top of the tank group could be under water or above the water surface, 2) a topsides to accommodate facilities used for drilling, oil and gas production and transportation, utilities and living, the topsides is above water and located on the top of tank group, and connected to the tank group by supported leg structures, 3) a positioning system for offshore floating platform, including a mooring leg system, or a dynamic positioning system, or a combination of both; or a foundation that could secure the offshore platform on seabed, including a long pile foundation or a suction pile foundation, or a sealing steel pile foundation, or a gravity foundation or the combination of a pile foundation and a gravity foundation.

For the offshore platforms as described above, the offshore platforms could be considered as an offshore floating platform or an offshore fixed platform.

For the offshore platform as described above, the tank group of the offshore floating platform comprises at least two tank units that are closely joined in parallel by connections and arranged vertically, and the vertical and parallel tank group consists of a body and a skirt bottom compartment attached to the lower portion of the body; the body comprises at least two tank units joined together in one layer or multi-layer concentric circles, either a central tank unit could be located at the center of concentric circles or not; each of the top and the bottom ends of the vertical parallel tank group is linked by a concrete connection structure which is extended outward to form a flat cylinder, i.e., a flat cylindrical connection structure with a diameter equal to the diameter of the circumscribed circle projected by the outer layer tank units; as to the vertical parallel tank group without central tank unit, its flat cylindrical connection structure has a central hole and this hole and the central space of the body become a penetrative moon pool.

For the offshore floating platform as described above, the bottom of the top flat cylindrical connection structure and the top of the bottom flat cylindrical connection structure protuberates up and down respectively along the vertical direction to form two conical surfaces, which reach and link with the outer surface of the vertical and parallel tank group to produce intersecting lines for the purpose of reducing the vertical wave forces caused by diffractions of water particles; the one-side cone angle of the conical surface is not greater than 45 degrees.

For the offshore platform as described above, which the skirt bottom compartment is circular or regular polygonal ring-like structure, and is fixed to the bottom flat cylindrical connection structure through multiple evenly distributed connecting structures; bottoms of the skirt bottom compartment and the flat cylindrical connection structure are in a same horizontal plane and their radial gap in-between is not less than 0.3 meters; the radial section of ring-like skirt bottom compartment is a rectangle with a bottom length no less than 0.3 times of radius of the flat cylindrical connection structure and with a height no less than 0.35 times of the bottom length; the top level of ring-like skirt bottom compartment is located at the water depth with little wave effects; the internal space of the skirt bottom compartment could be divided into one or more sub-compartments for liquid storage, and/or seawater ballast, and/or fixed ballast.

For the offshore platform as described above, nicks are designed at the inner circle of the skirt bottom compartment for the mooring legs passing, and the dimensions of the nicks should guarantee that the mooring leg system and the skirt bottom compartment would not contact or collide to each other during offshore platform motions; alternatively, the skirt bottom compartment is totally disconnected at the nicks to be divided into multiple uniform sub-compartments.

The offshore platform as described above, which has at least two parallel and horizontal tank groups and each contains at least two tank units being laid horizontally and connected end-to-end in series to form a long horizontal cylinder; the two horizontal tank groups with a certain distance are floating below waterline and connected to each other in parallel by multiple horizontal connecting rods in the middle and plates at both ends to form as a complete structure; both ends of inner steel tank inside each tank unit are cylindrical epitaxial structure; when the epitaxial structures of the two adjacent inner steel tanks are fixing connections, they could be welded together and then attached to the outer concrete tanks; when the epitaxial structures of the two adjacent inner steel tanks are sliding connections, or one is sliding and the other one is fixing, they could be plugged-in and then joined to the outer concrete tanks, and so each sliding epitaxial structure could slide inside the connection of the outer concrete tanks, as well as inside or outside the cylinder of the other epitaxial structure.

To accomplish the above objects, the present application proposes a tank unit comprising an outer concrete tank including an outer tank shell, two heads, and ring shell connections at both ends of the outer tank shell, an inner steel tank inside the outer concrete tank including an inner tank shell, two inner heads, two epitaxial structures at both ends of the inner tank shell, and an isolation layer, being formed from a gap between the outer concrete tank and the inner steel tank. The inner steel tank is connected to the ring shell connections of the outer concrete tank by the epitaxial structures. The gap is filled with an isolation medium.

The present application further proposes a tank group comprising two or more tank units are closely connected in parallel or in series by group connections. The tank units in the tank group are arranged vertically to become a vertical tank group or arranged horizontally to become a horizontal tank group. The tank unit comprises an outer concrete tank, an inner steel tank inside the outer concrete tank and connected with the outer concrete tank via ring shell connections of the outer concrete tank and epitaxial structures of the inner steel tank, and an isolation layer in between the outer concrete tank and the inner steel tank.

The present application also proposes an offshore platform comprising a tank group comprising two or more tank units, wherein the tank unit comprises an outer concrete tank, an inner steel tank inside the outer concrete tank and connected with the outer concrete tank via ring shell connections of the outer concrete tank and epitaxial structures of the inner steel tank, and an isolation layer in between the outer concrete tank and the inner steel tank, a topsides, including facilities used for drilling, oil and gas production and transportation, utilities, or living, wherein the topsides is above water and located on a top of the tank group, and connected to the tank group by supported leg structures, and a positioning system or a foundation. The positioning system is used with the offshore platform when the offshore platform is floating, and comprises one or more of: an anchor mooring system or a dynamic positioning system. The foundation fixes the offshore platform on a seabed and comprises one or more of: a long pile foundation, a suction pile foundation, a sealing steel pile foundation, or a gravity foundation.

Compared with existing designs, the present application has the following features and advantages:

The steel plate and concrete composite tank unit in this invention gains advantages of both concrete and steel, and avoids their disadvantages. Stresses distribution inside the tank unit has been refined by utilizing the isolation layer between the outer concrete tank and the inner steel tank, and the static pressure of water/stored liquid outside/inside the tank unit. Due to the isolation layer, the underwater tank unit is a double-layer tank, one layer damage on the tank unit would not cause any risk of leakage. Therefore, it is safe and eco-friendly. Since excellent internal pressure resistance of steel tank, the discharging liquids inside the inner steel tank could be achieved by the gas pressure above the liquids, which avoids using pump room, deep-well pump and submersible pump. At the same time, the tank unit could be used for all kinds of liquid products such as LNG, which has advantages of little technology challenge and low complexity on construction, short construction period, low cost, easy maintenance, and so on.

The offshore floating platform and fixed platform using the steel plate and concrete composite tank unit in this invention has been optimized compared with the offshore platforms with underwater storage based on the two previous inventions mentioned above, especially the floating platforms, in terms of overall performance and structural design. Therefore, such optimized floating platform fully meets the requirements of drilling and dry wellhead installation, and extends its range of application to the offshore oil and gas field production, and LPG/LNG production and storage. As to the fixed platform with a sit-on-bottom storage tank group, this invention also proposes a new type of long pile as the platform foundation, and the associated installation and removal methods using the weight and the buoyancy of the platform and through ballasting/de-ballasting. The added skirt bottom compartment to the tank group and the platform solves the issue of floating in shallow draft (7 to 9 meters for instance) during construction and towing.

BRIEF DESCRIPTION OF THE DRAWING

These drawings described herein are only used for the purpose of interpretation, with no intention to limit the scope of the present invention in any way. Further, the shape and the size of each component are only schematics to help understanding the invention, instead of defining them specifically. Engineers in this field could customize shapes and dimensions to implement the invention, by considering the guidance in this application and local realistic situation.

Description of appended drawing reference numbers is as follow:

1. Tank Unit, 2. Outer Concrete Tank, 3. Outer Tank Shell, 4. Heads and Ring Shell Connections of the Outer Concrete Tank, 5. Inner Steel Tank, 6. Cylindrical Inner Steel Shell, 7. Cylinder Epitaxial Structure of the Inner Steel Tank, 8. Leg Epitaxial Structure of the Inner Steel Tank, 9. Isolation Layer, 10. Liquid Storage Compartment, 11. Seawater Ballast Compartment, 12. Tank Group, 13. Flat Cylindrical Connection Structure, 14. Moon Pool, 15. Topsides, 16. Support Leg of the Topsides, 17. Conical Surface, 18. Annular Skirt Bottom Compartment of the Vertical and Parallel Tank Group, 19. Connecting Structures of the Skirt Bottom Compartment, 20. Cylindrical Fixing Connection, 21. Cylindrical Sliding Connection, 22. Reserved Expansion Space for the Cylindrical Sliding Connection, 23. Mooring Leg Nick for the Annular Skirt Bottom Compartment, 24. Body of the Vertical and Parallel Tank Group, 25. Skirt Bottom Compartment Attached at Both Lower Sides of the Body of the Vertical and Parallel Tank Group, 26. Sealing Steel Pile, 27. Water Intake Valve, 28 Release Valve, 29. Air Intake Valve, 30. Top Head of the Sealing Steel Pile, 31. Tubular Pipe of the Sealing Steel Pile.

DETAILED DESCRIPTION OF THE INVENTION

Drawings and descriptions of embodiments can make the invention clearer. However, those described embodiments are only used to explain the purpose of the invention, and could not be interpreted as limiting the invention by any means. Engineers in this field, under the guidance of the invention, could conceive any possible deformation based on this invention, which should be considered as belongs to the scope of this invention.

Tank Unit

Figure 1:
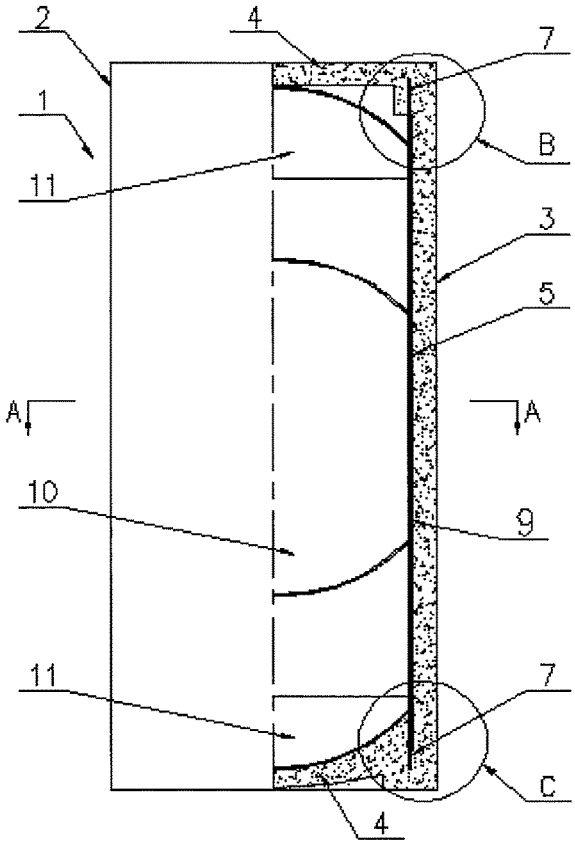
FIG. 1 is a schematic of the steel plate and concrete composite tank unit.
Figure 2:
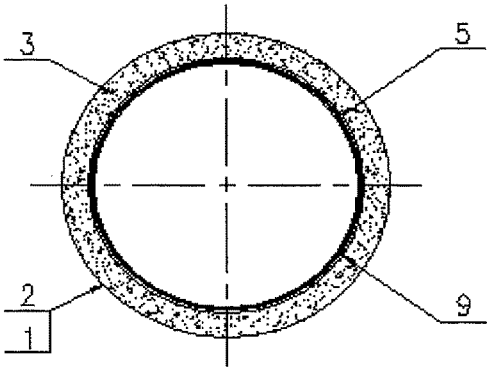
FIG. 2 is a sectional view of FIG. 1 from A-An axis.

Referring to FIG. 1 to FIG. 4, they are a schematic of the steel plate and concrete composite tank unit, a sectional view of FIG. 1 from A-A axis, a detail view of part B in FIG. 1, and a detail view of part C in FIG. 1, respectively. As shown in the figures, the steel plate and concrete composite tank unit 1 in this embodiment comprises following components.

Figure 3:
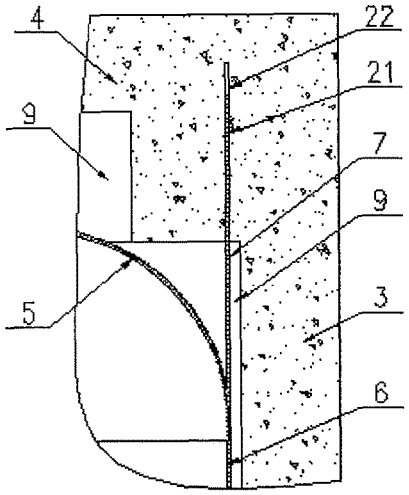
FIG. 3 is a detail view of part B in FIG. 1.
Figure 4:
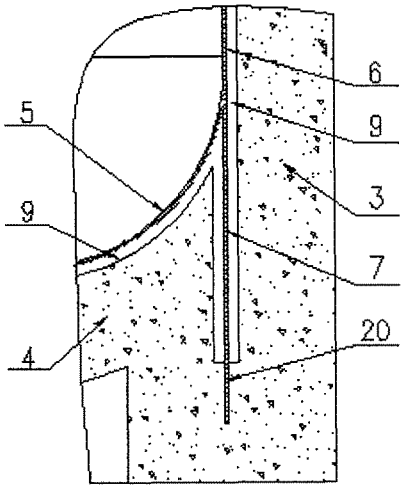
FIG. 4 is a detail view of part C in FIG. 1.

An integral rigid concrete outer tank (hereinafter referred as "outer concrete tank 2"), which is composed of an outer concrete tank shell (hereinafter referred as "outer tank shell 3"), two heads and ring shell connections 4 located at both ends of the outer tank shell. The heads include arched one and plate one (as shown in FIGS. 3 and 4). The concrete structure in this embodiment refers to all types of concrete-oriented ones, such as reinforced concrete structure, pre-stressed concrete structure, steel-bar concrete structure, bi-steel concrete structure and fiber reinforced concrete structure.

Figure 5:
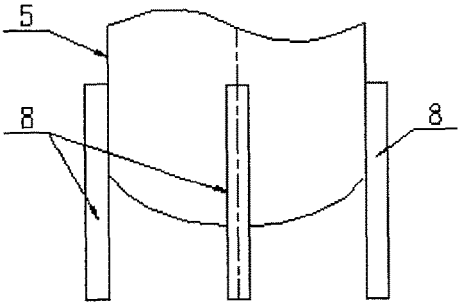
FIG. 5 is a schematic view of leg epitaxial structures of the inner steel tank.

An inner steel tank 5 inside the outer concrete tank 2, comprises a cylindrical steel shell (hereinafter referred to as " inner tank shell 6"), and two epitaxial structures at both ends of the inner tank shell 6. The inner tank shell 6 is connected to the ring shell connections 4 in the outer tank shell 3 by epitaxial structures. In an alternative embodiment, the epitaxial structures are cylindrical epitaxial structures 7 (as shown in FIGS. 3 and 4) formed by extending both ends of the inner tank shell 6. In another alternative embodiment, the epitaxial structures are leg epitaxial structures 8 (as shown in FIG. 5) formed by extending both ends of the inner tank shell 6 respectively.

An isolation layer 9 is the gap between the outer concrete tank 2 and the inner steel tank 5 (including the gap between the inner tank shell 6 and the outer tank shell 3, and between heads of the inner steel tank 5 and the outer concrete tank 2). The gap is filled with an isolation medium, as shown in FIGS. 3 and 4. The isolation medium in the gap is an inert gas or a liquid, or an inert gas with a flexible solid material, or a liquid with a flexible solid material. The main function of the gap is to avoid or reduce the probability of strain and stress caused by the inner/outer pressure being directly transferred between the inner steel tank and the outer concrete tank.

The steel plate and concrete composite tank unit in this embodiment could be used to store industrial liquid products, such as crude oil, refined oil, LNG, LPG and so on. The tank unit takes full advantage of the excellent compression resistance of concrete and the high tensile stress of steel. Its structural strength could be increased tremendously, since the steel wall of the inner steel tank is under tension, and the concrete wall of the outer concrete tank is under compression. Also, it has advantages of little technology challenge and low complexity on construction, short construction period, low cost and easy maintenance.

As an alternative embodiment of the connection between the inner steel tank 5 and the outer concrete tank 2, the bottom end of the epitaxial structure of the inner steel tank 7 is fixed onto the bottom end of the ring shell connections of the outer concrete tank 4, forming a fixing connection structure 20 (as shown in FIG. 4). The top end of the epitaxial structure of the inner steel tank 7 is inset into the top end of ring shell connections 4 of the outer concrete tank 2, resulting in a sliding connection 21 (as shown in FIG. 3). The sliding connection enables the inner steel tank 5 to slide in the outer concrete tank 2 along the central axis and to release the internal pressure-induced axial elongation of the inner tank, an expansion space of sliding connection 22 is reserved (see FIG. 3). The outer concrete tank 2, the inner steel tank 5 and the isolation layer 9 would combined as an integrated structural by the fixing connection 20 and sliding connection 21.

As an alternative embodiment for the inner steel tank 5, the inner steel tank 5 could be a combined liquid storage tank (hereinafter referred to as "combined tank") that comprises at least one pair of liquid storage compartment 10 and seawater ballast compartment 11 respectively in symmetrical form. During the liquid loading/offloading processes, the combined tank could be adjusted its operating weight, and even keep it constant by calibrating ballast. The liquid storage compartment 10 and the seawater ballast compartment 11 in each combined tank would be arranged in three types: vertically/horizontally end-to-end, or pot-in-pot.

Vertical end-to-end type means that cylindrical inner tank shell 6 of the inner steel tank 5 being laid vertically could be divided into two parts of upper and lower by a middle head. One of them is liquid storage compartment, and the other one is seawater ballast compartment. Also, cylindrical inner tank shell 6 as shown in FIGS. 1 and 3 could be divided into three parts by two middle heads, the upper one, the middle one and the lower one, and among them, the largest one is liquid storage compartment that usually locates in the middle, the other two are seawater ballast sub-compartments that usually locates at both ends. These two ballast sub-compartments normally are connected by a pipe (not shown in FIG. 1) to form one essential seawater ballast compartment.

Horizontal end-to-end type means the cylindrical inner tank shell 6 of the inner steel tank 5 being laid horizontally could be divided into three parts, the right one, the middle one and the left one by two middle heads and among them, the largest one is a liquid storage compartment located in the middle, the other two located at ends are seawater ballast sub-compartments being interconnected by a pipe to form one essential seawater ballast compartment.

Pot-in-pot type means liquid storage compartment 10 locates inside the seawater ballast compartment 11 by sharing a same central axis.

As an alternative embodiment for inner steel tank 5, the inner steel tank 5 could be a liquid storage compartment only, without seawater ballast compartment.

To resist corrosion, surfaces of the inner steel tank 5 of the tank unit 1 which contact corrosive liquids such as sea water are coated with a protective coating.

Regarding the inner steel tank 5 in this embodiment, its liquid storage compartment 10 could be used to store industrial liquid products, such as crude oil, refined oil, LNG, LPG and so on. The liquid storage compartment wall is single-wall made of steel or multi-wall, so that they could adapt to the characteristics of different industrial liquids. For example, multi-walls of liquid storage compartment used to store cryogenic liquids such as LNG are usually made up of, from outside toward inside, a) 16MnR steel tank layer, b) low temperature heat insulation material layer, such as nitrogen-pressurized perlite, c) cryogenic steel layer, such as Austenitic stainless steel 0Cr18Ni9 that exhibit excellent low temperature resistance. The support structures between the inner layer and the outer layer are made of fiber glass epoxy plastic and 0Cr18Ni9 steel plate that shows excellent low temperature resistance and heat insulation performance. When the liquid storage compartment is used to store liquids in high temperature such as heated crude oil, heat insulation layer could be added.

As mentioned above, the main function of the isolation layer 9 is to avoid strain and stress being directly transferred between the inner steel tank 5 and the outer concrete tank 2. The system pressure inside isolation layer 9 is controllable and could be released safely. In order to reduce the pressure load acting on the outer concrete tank 2 and the inner steel tank 5, this system pressure could be determined by external pressure acting on the outer concrete tank 2 and internal pressure acting on the inner steel tank 5. If system pressure of the isolation layer is equal to the pressure of seawater outside the tank unit (among various available methods, the simplest method is to connect isolation layer to external seawater), the internal and the external pressures of the outer concrete tank of tank unit are equal, which significantly affects the structure design of a deep water storage tank. Taking a tank unit used for crude oil storage as an example, wherein the inner steel tank is 40 meters high and its bottom head is located at 1000 m below waterline, if the crude oil need to be lifted to 20 meters above waterline by the pressure of compressed-nitrogen inside the inner steel tank, the minimum of compressed-nitrogen pressure is of an oil column length 1020 meters, and so a pressure of 102 atmospheres selected for the nitrogen. Since the isolation layer of the tank unit is connected to external seawater, the maximum external hydrostatic pressure at the bottom head of the inner steel tank is about 100 atmospheres, and the minimum external hydrostatic pressure at the top head of the inner steel tank is about 96 atmospheres. Therefore, internal design pressure of inner steel tank is about 6 (=102−96) atmospheres instead of 106 atmospheres. Further, because of balance between the internal/the external pressure of the outer concrete tank, this outer concrete tank could not be designed as per pressure vessel. Liquid inside the liquid storage compartment and seawater inside the seawater ballast compartment can be discharged by a gas pressure instead of a pump, which avoids using deep underwater pump, and reduces the costs related to operation and maintenance. This is one of the advantages of the tank unit in this embodiment.

For the tank unit with seawater ballast compartment and liquid storage compartment, the stored liquids could be displaced in an equal or unequal mass flow rate with ballast seawater during the offloading process. "Equal mass flow rate displacement system for seawater ballast and stored liquid under a closed, gas-pressurized and interconnected condition" and "equal mass flow rate displacement system for seawater ballast and LNG/LPG" is recommended preferentially for normal stored liquids and LNG/LPG respectively.

Tank Group

Figure 7:
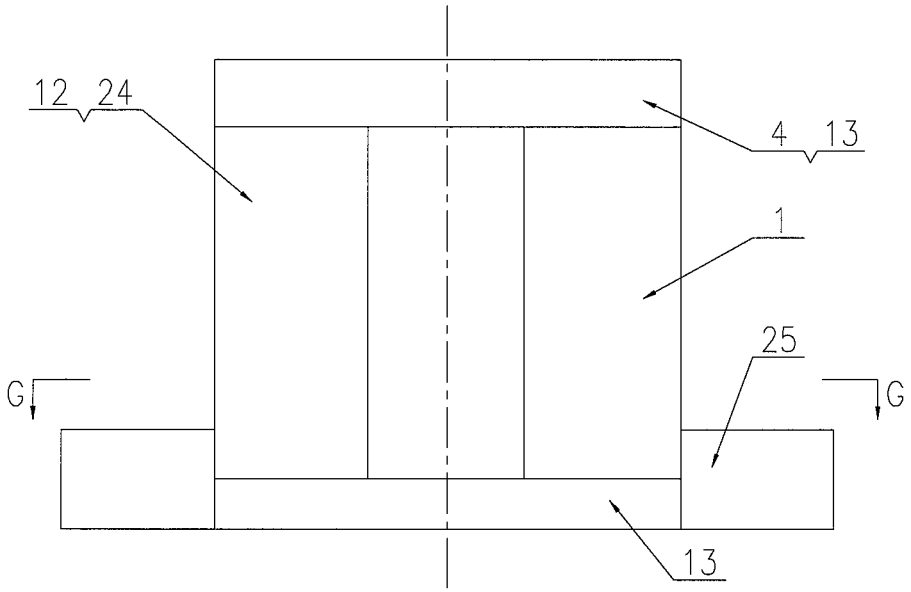
FIG. 7 is a schematic view of the vertical tank group arranged in a square honeycomb pattern.
Figure 8:
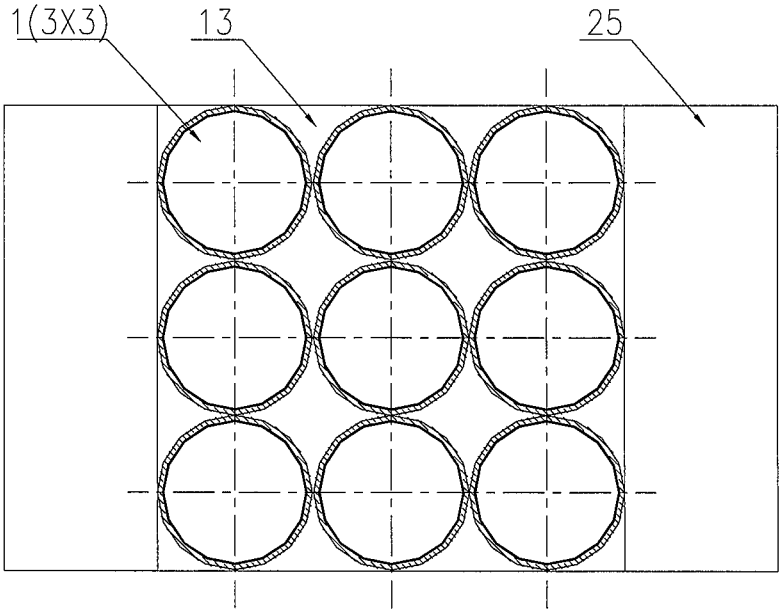
FIG. 8 is a sectional view of FIG. 7 from G-G axis.

Referring to FIG. 7, it is a schematic view of vertical tank group arranged in a square honeycomb pattern, and FIG. 8 is a sectional view of FIG. 7 from G-G axis. This embodiment also provides a type of tank group 12 that is used to store industrial liquids in an offshore environment. The tank group 12 comprises at least two tank units 1, as mentioned above, that are fixed in parallel or in series by group connection to form a floating or a fixed tank groups 12 used for storage of offshore industrial liquids. Alternatively, tank group 12 could have one tank unit only. The tank units 1 in the tank group 12 could be arranged vertically to become a vertical tank group, or arranged horizontally to become a horizontal tank group. The top of the tank group 12 could be either below or above the waterline. The floating tank group would be anchored on seabed by mooring legs. The fixed tank group would be fixed on seabed by suction piles, or long piles foundation, or gravity foundation, or piles with gravity foundation.

Figure 9:
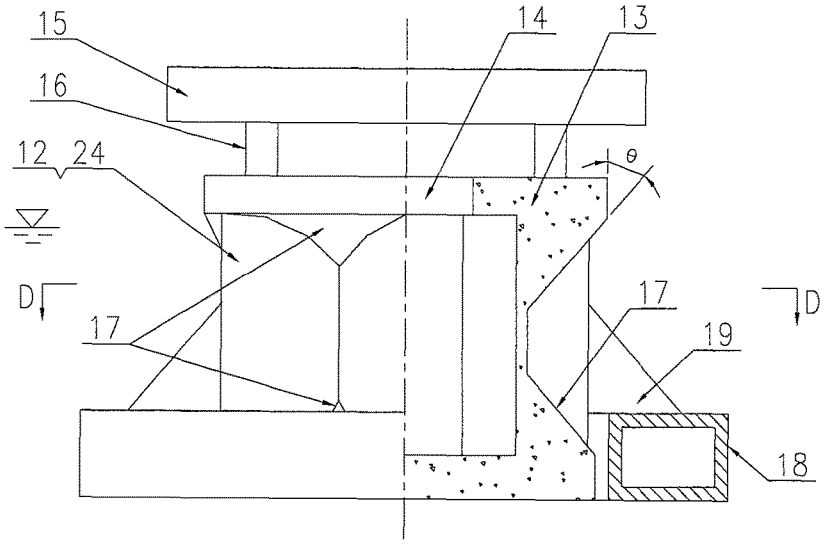
FIG. 9 is a schematic view of the offshore floating platform.
Figure 10:
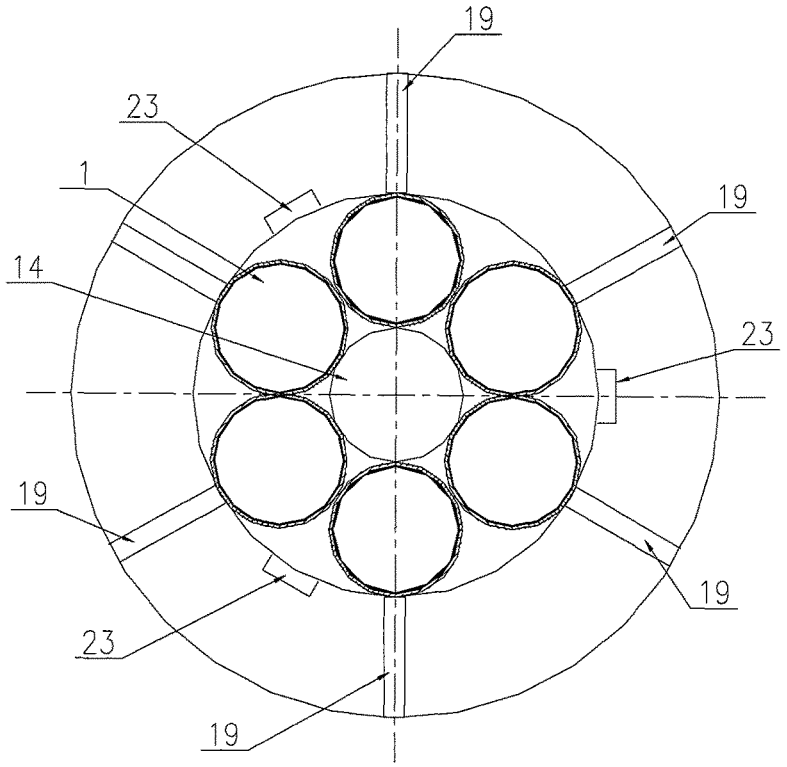
FIG. 10 is a sectional view of FIG. 9 from D-D axis.

Further, the vertical and parallel tank group 12 comprises a body 24 and a skirt bottom compartment 25 at lower part of the body. The main body 24 has nine tank units (see FIGS. 7 & 8, that means more than two) which are connected closely in parallel and arranged in rectangular honeycomb, or other shapes such as a hexagon, a multilayer concentric circles. These tank units could be connected by two ends of the group connections of the outer concrete tank as an integrated structure in addition to some auxiliary connections in-between the outer tank shells 3. The group connection is formed from the heads of the outer concrete tanks of the nine tank units as a (rectangular) flat cylindrical connection structure 13 as shown in FIG. 7. The skirt bottom compartments 25 are attached at both lower sides of the body of the vertical and parallel tank group 4. Referring to FIG. 9 and FIG. 10, the tank group of a floating platform 12 in FIG. 9 is a vertical and parallel tank group that comprises body 24 including six tank units 1 and a ring-like skirt bottom compartment 18. The body 24 and the skirt bottom compartment 18 could be connected directly to form a complete structure for fixed facilities; or as shown in FIG. 9 and FIG. 10, due to the remaining radial gap, the skirt bottom compartment 18 becomes an independent "ring", the body 24 and the skirt bottom compartment 18 could be connected together by connecting structures 19 of skirt bottom compartment 18 especially for floating facilities. As shown in FIG. 10, the skirt bottom compartment 18 is a circle, or it could be regular polygon annulus. The regular polygon ring-like skirt bottom compartment could be formed by multiple elongated skirt bottom sub-compartments and each sub-compartment could be a side of the regular polygon. The construction of the elongated skirt bottom sub-compartment is easier than the circular skirt bottom compartment. As shown in FIG. 7 and FIG. 9, the radial section area of the skirt bottom compartment could be either a rectangle or a regular polygon. Bottoms of the skirt bottom compartment and the body are in a same horizontal plane, while the bottom compartment height is far less than the body. Additionally, the bottom compartment top is submerged in water in the in-place condition. Internal space of the skirt bottom compartment could be arranged as one or multiple forms as follow: liquid storage compartment, seawater ballast compartment, and solid ballast compartment. Functions of the skirt bottom compartment are to increase buoyancy for construction and towing, to adjust the position of the center of gravity and increase self-weight, to increase added mass and damping of the floating tank group, to improve its hydrodynamic performance, and to reduce the seabed erosion for the fixed tank group.

Lying down the body of vertical and parallel tank group 24 could form a horizontal and parallel tank group.

Figure 11:
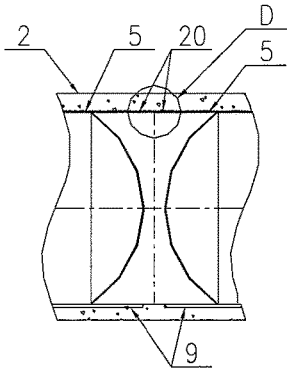
FIG. 11 is a sectional view of connection details of two adjacent tank units within a horizontal tank groups: option one.
Figure 12:
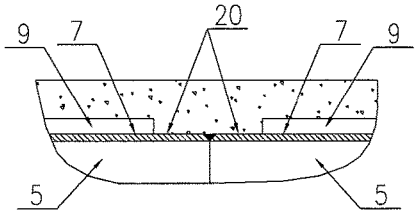
FIG. 12 is a detail view of part D in FIG. 11.
Figure 13:
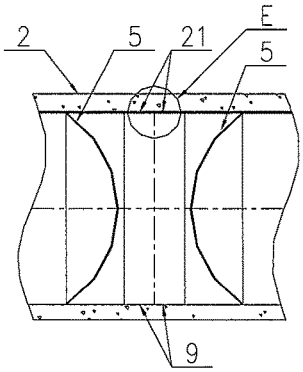
FIG. 13 is a sectional view of connection details of two adjacent tank units within a horizontal tank groups: option two.
Figure 14:
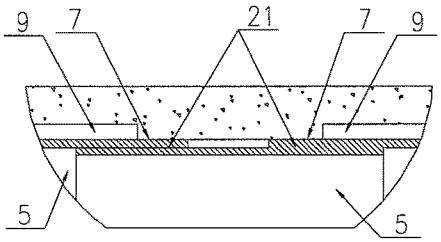
FIG. 14 is a detail view of part E in FIG. 13.
Figure 15:
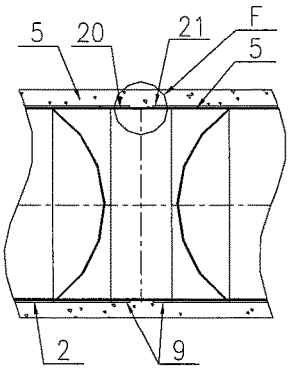
FIG. 15 is a sectional view of connection details of two adjacent tank units within a horizontal tank groups: option three.
Figure 16:
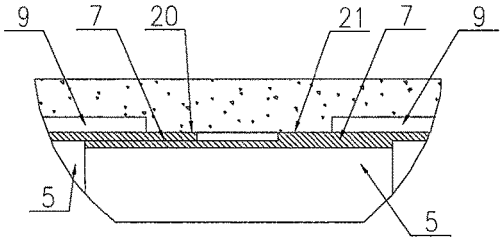
FIG. 16 is a detail view of part F in FIG. 15.

As shown from FIGS. 11 to 16, the outer concrete tank shells 2 of multiple tank units 1 of the horizontal group tank could be connected end-to-end in series to build a long cylindrical horizontal tank group. Two ends of the inner steel tank 5 inside each tank unit 1 are cylindrical epitaxial structures 7. When the cylindrical epitaxial structures 7 of two adjacent inner steel tank 5 are fixed via fixing connection 20 (as shown in FIGS. 11 and 12), they could be welded together (as shown in FIG. 12) then fixed to fixing connection 20 of the outer concrete tanks 2 (as shown in FIG. 11). When the epitaxial structures 7 of two adjacent inner steel tanks 5 are sliding connection 21 (as shown in FIGS. 13 and 14), or one is sliding connection 21 and the other one is fixing connection 20 (as shown in FIGS. 14 and 15), these two cylindrical epitaxial structures 7 could be plugged-in, then joined to the connection of the outer concrete tanks 2 through sliding connection 21 (see FIGS. 14 and 16) or fixing connection 20 (see FIG. 16), and so each sliding epitaxial structure could move inside connecting segment of the outer concrete tanks 2, as well as inside or outside the cylinder of the other epitaxial structure 7 (see FIGS. 13, 14 and FIGS. 15, 16).

Placing the said long cylindrical horizontal tank group vertically, it could form a vertical and in-series tank group.

Figure 6:
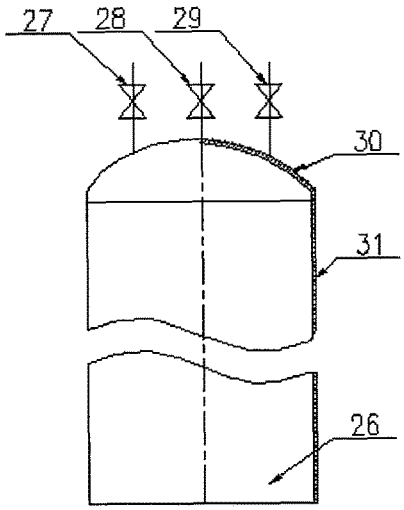
FIG. 6 is a schematic view of the sealing steel pile.

Further, FIG. 6 shows a schematic view of a sealing steel pile. The long pile foundation of the fixed tank group in this embodiment is a sealing steel pile 26 that comprises a steel tubular pipe 31, a top head 30, a release valve 28, an air intake valve 29 and a water intake valve 27. The sealing steel pile 26 is inserted into the pile sleeve of the tank group, and is temporarily fixed onto the tank group before towing. The sealing steel pile 26 is pressed into a seafloor by the self-weight of the tank group after ballasting during offshore installation. The installation steps are below: 1) towing tank group to sea site, locating and positioning, opening the release valve 28, releasing temporary fixed connection on sealing steel pile 26, pressing long sealing steel piles 26 into the seafloor by the self-weight of the sealing steel piles 26, 2) temporarily connecting the sealing steel piles 26 onto the tank group again, ballasting water to the tank group to make it sink and press the sealing steel piles 26. Meanwhile, attentions are required on timely adjusting the quantity of ballast water in different orientations depending on the level of the tank group, 3) releasing the temporary fixed connections on the sealing steel piles 26 after the tank group reaches the seabed, draining away ballast water to make the tank group float again, 4) repeating the steps of pressing sealing steel pile 26—floating—pressing sealing steel pile 26 again, until the sealing steel piles 26 reach the design depth below mud-line, making the tank group sit on the seabed, then connecting the sealing steel pile 26 onto the tank group finally, 5) injecting water through the water intake valve 27 and exhausting the air, then closing all the three valves 27, 28 and 29 after water is full, discharging redundant ballast water in tank group to complete the offshore installation. The purpose to inject water to the piles is to make the soil plugs inside the piles be able to bear loads at once after pile installation.

When the existing offshore facilities fixed by a pile foundation need to be relocated or removed, connections between the pile foundation and the facilities have to be released usually by cutting pile. The sealing steel piles 26 as foundation are used for the fixed tank group in this embodiment. The sealing steel piles 26 could be pulled up from the seafloor through draining and flouting the tank group, and then the tank group can remove via wet towing. The steps of the piles extracting are following: 1) draining away water and the ballast inside the tank group to make it loaded lightly, opening the release valve 28 to make the tank group float and to start the initial process of pulling sealing steel piles 26 up, 2) when the tank group floats up to water surface, removing the fixing connections on the sealing steel piles 26 after injecting water into the sealing steel piles 26 fully and closing all valves 27, 28 and 29, the water columns inside the sealing steel piles 26 could avoid the long sealing steel piles 26 sink by self-weight, 3) ballasting water into the tank group to make it sink to the seabed again, temporarily fixing the sealing steel piles 26 onto the tank group again, 4) repeating the steps of removing loads to pull the sealing steel piles 26 up, injecting water into the sealing steel piles 26 to avoid the sealing steel piles 26 sink and releasing the fixing connections on the sealing steel piles 26, ballasting the tank group till it sitting on seabed and temporarily fixing the sealing steel piles 26, and draining and floating the tank group to pull the sealing steel pile 26 again until the sealing steel piles 26 above mud-line. When pulling sealing steel piles 26 up near to mud-line, pulling-up forces on the sealing steel piles 26 could be increased by injecting air through air intake valve 29 in addition to buoyancy, 5) connecting the sealing steel piles 26 to the tank group to complete the process of pulling sealing steel piles 26.

During the operation process, the sealing steel pile could be pressed into the seabed or pulled up from the seabed, by operating the release valve, the intact valve and the inlet valve and adjusting the self-weight of the tank group and ballasting water.

Offshore Platform

This embodiment also offers an offshore platform for the development of offshore oil and gas fields, drilling, oil and natural gas production, natural gas liquefaction, natural gas chemical industry and liquid storage, including two types: floating offshore platform, and fixed offshore platform. As shown in FIG. 9, the offshore platform comprises following three components, 1) an underwater storage tank, which comprises one or more the tank group 12 as mentioned above, and is used for storing the platform-produced liquids, such as crude oil, LPG, LNG and gas to liquid (GTL), methyl alcohol for example. The top of the tank group(s) could be under water or above water surface. When the offshore platform has drilling or wellhead facilities, it could set a penetrative moon pool in the tank group(s); 2) a topsides 15, connected to the top of the tank group 12 by support legs 16 and above waterline, including the required facilities used for drilling, oil and gas production and transportation, utilities and living; 3) a positioning system for the offshore floating platform, including a mooring leg system, a dynamic positioning system (not shown in FIG. 9), or a combination of both; or a foundation that could secure offshore platform on a seabed, including a long pile foundation, a suction pile foundation, a sealing steel long pile foundation, or a gravity foundation or the combination of a pile foundation and a gravity foundation.

The offshore platform could have a variety of structural forms. FIG. 9 shows an embodiment of the offshore platform in present application. This offshore platform is offshore floating artificial island, which top is above water surface. If the top of the floating tank group of the platform is submerged in certain depth, and the support legs 16 also have enough water plane area to secure the stability of the floating platform, resulting in a platform with underwater storage tanks. If tank group 12 of the platform is fixed on a seabed directly and its top is above waterline, the platform becomes a fixed artificial island. If the top of the tank group of the platform is submerged in certain depth, the platform become a fixed platform with underwater storage tanks.

The stored liquids produced by the offshore platform and the ballast seawater could be exported by offloading pump (s), such as pumps in pump room, deep well pumps or outer subsea pumps. Also, the liquids and seawater could be lifted by pressure energy of compressed oxygen-free gases to the inlet of offloading pump installed above water, then offloaded by the pump. Such oxygen-free gas could be a nitrogen or a natural gas. The advantages of the former are low pressures inside the storage compartment and the seawater ballast compartment, small amount of steel work and low cost of the inner steel tank. However, its disadvantages are the complex of the compartment system, heavy maintenance work, high construction and operation cost of pumps. The latter is opposite, where pressures inside the storage compartment and the seawater ballast compartment are higher, wall steel plate of the inner tank is thick, a conventional centrifugal pump could be used as offloading pump, system is simple and maintenance is less. The present application recommends the use of gas pressure with offloading pump. During offloading process, the stored liquids could be displaced in an equal or unequal mass flow rate with ballast seawater, or not displaced with seawater. "Equal mass flow rate displacement system for ballast seawater and stored liquid under a closed, gas-pressurized and interconnected condition" and "equal mass flow rate displacement system for ballast seawater and LNG/LPG" is recommended preferentially. Equal mass flow rate displacement system guarantees that the operation weight and the draft of the platform is unchanged during the processes of loading and offloading, which has a significant meaning to the floating platforms with dry wellhead. For the floating platforms without dry wellhead, during loading/offloading process, the stored liquid could be displaced in unequal mass flow rate with the ballast seawater, or even not displaced with seawater, only relying on self-correcting mechanism between the platform's loading and draft so as to balance the loading and the buoyancy. Its advantage is the volume of the liquid storage compartment 10 of the inner steel tank 5 has been tremendously increased, as well as storage volume of the platform.

As shown in FIGS. 9 and 10, a vertical and parallel tank group 12 with a skirt bottom compartment 18 is selected as the underwater storage tank of the offshore floating platform. The tank units of the tank group are joined together in one layer or multilayer of concentric circles, and at the center of the circle, a central tank unit may be or not be installed (FIG. 10 shows a tank group of six tank units 1 arranged in one circular layer which has no central tank unit). Each end of the outer concrete tanks of the vertical and parallel tank group is connected one by one and extended outward to form a group connection, i.e., a flat cylindrical connection structure 13, which diameter is equal to the diameter of circumscribed circle projected by the outer layer tank units. When the vertical and parallel tank group does not have central tank unit, the flat cylindrical connection structure also has a hole at its center, which diameter is equal to the diameter of the missing central tank unit to form a penetrative moon pool 14. The bottom of the vertical and parallel tank group 12 is located below waterline where wave have little effects.

What's more, the vertical and parallel tank group 12 of the offshore floating platform, wherein the bottom of the top flat cylindrical connection structure 13 and the top of the bottom flat cylindrical connection structure 13 protuberates up and down respectively along the vertical direction to form two conical surfaces 17, which reach and link with the outer surface of the parallel tank group to produce intersecting lines for the purpose of reducing the vertical wave forces caused by diffractions of water particles; the single-side cone angle of the tapered surface is not greater than 45 degrees (as shown in FIG. 9).

Further, the skirt bottom compartment 18, located at lower body of vertical and parallel tank group 24, is circular or regular polygonal ring-like structure, and is fixed to the flat cylindrical connection structure 13. The bottoms surface of the said structures are in a same horizontal plane. The radial section of the annular skirt bottom compartment 18 is rectangular, and the width of the radial section is no less than 0.3 times of radius of the flat cylindrical connection 13 and the height is no less than 0.35 times of the width. The skirt bottom compartments 18 are joined to the flat cylindrical connection structure 13 through multiple evenly distributed connecting structures 19. It is noted that connecting structure 19 is for the purpose of illustrations, its real shape and dimension need to be determined through design calculation based on specific on-site condition. The minimum radial gap between the skirt bottom compartment 18 and the flat cylindrical connection structure 13 is not less than 0.3 meters. The top level of ring-like skirt bottom compartment is located at the water depth where wave has little effect, and such depth in South China Sea is usually no less than 30 m below waterline. The internal space of the skirt bottom compartment could be divided into one or more sub-compartments for liquid storage, seawater ballast, and/or fixed ballast (not shown in FIG. 9 for simplification). For those platforms which fairleads of the mooring legs are located above the ring-like skirt bottom compartment 18, some nicks are designed at the inner circle of the skirt bottom compartment, i.e. mooring leg channels 23. The dimension of each nick should guarantee that the mooring leg system and the skirt bottom compartment would not contact or collide during the offshore platform motions. Alternatively, the skirt bottom compartment is totally disconnected at the nicks to be divided into multiple uniform sub-compartments. The skirt bottom compartment has three important functions: 1), adjusting the center of gravity of the platform by adding solid ballast; 2), improving its hydrodynamic performance by increasing added mass and damping; 3), providing sufficient buoyancy and water plane area during construction and wet-towing to make sure that the platform could float in the condition of small draft (about 7~9 meters for instance), as well as that the towing buoyancy and stability are sufficient. The skirt bottom compartment 18 and its connecting structure 19 could be steel structure, reinforced concrete structure, or composite structure.

The floating platform in this application has the characteristic of intrinsic stability with optimizations mentioned above. In another word, the motion response of the floating tank group/platform is very small in harsh sea condition. The reason is: the natural periods of the floating tank group/platform are increased, for example, the natural heaving period increased from more than 20 seconds to more than 30 seconds, the gyration radius of rolling and pitching and the motion damping increased as well; however, wave load not increased so much. All these make the hydrodynamic performance of the floating platform in this invention is better than existing Spar platform.

Further, the floating offshore platform has two horizontal tank groups and each contains at least two tank units being laid horizontally and connected end-to-end in series to form a long horizontal cylinder; the two horizontal tank groups with a certain distance are floating below waterline and connected to each other in parallel by multiple horizontal connecting rods in the middle or two plates at both ends to form as a complete structure. Both ends of the inner steel tank inside each tank unit are cylindrical epitaxial structure. When the epitaxial structures of the two adjacent inner steel tanks are fixing connections, they could be welded together and then attached and fixed to the outer concrete tanks (as seen in FIGS. 11 and 12). When the epitaxial structures of the two adjacent inner steel tanks are sliding connections, or one is sliding and the other one is fixing, they could be plugged-in and then joined to the outer concrete tanks. Therefore, each sliding epitaxial structure could move inside the connection of the outer concrete tank, as well as inside or outside the cylinder of the other epitaxial structure (as seen in FIGS. 13, 14, 15 and 16).

What's more, the long piles foundation of the offshore fixed platform is sealing steel long piles foundation. Since the structure of the sealing steel long pile used for the said fixed platform, as well as the methods and steps of pile pressing and pulling out are same as the one used for the fixed tank group mentioned above, no need to repeat here. It is noted that levelness of the platform need to be controlled during pile pressing and pulling out processes. When in the process of pile pulling out, all unneeded liquid and bulk cargo on the topsides of the platform, as well as all liquids and ballast in the tank group of the platform should be removed to reduce loads of the platform.

In conclusion, the new type of tank unit with steel plate and concrete composite structure provided by this application is for storing industrial liquid products underwater, such as crude oil, refined oil, LNG, LPG and so on. The tank unit takes full advantages of steel and concrete, since the steel wall of the inner steel tank is only subjected to tensile stresses and the concrete wall of the outer concrete tank is only subjected to compressive stresses. Multiple tank units mentioned above are bonded together to form a tank group. When the tank group in this application is floating at sea, it becomes an offshore floating storage tank; when it fixed on seabed, it becomes an offshore fixed storage. The topsides above water installed on the tank group by using leg structures, resulting in a floating or a fixed platform with underwater storage tanks. This platform could be used for offshore oil and gas drilling, oil and gas production, storage of liquid productions, such as crude oil, liquefied petroleum gas, and liquefied natural gas.

The described specific embodiments mentioned above are only used to explain the purpose of the invention to provide a better understanding, and could not be interpreted as limitations to the invention in any way. In particular, various features in different embodiments described herein could be combined mutually and arbitrarily to form other implementation methods; unless there was a clear contrast descriptions, these features should be understood as can be applied to any embodiment, not limited to the embodiments described herein.

What is claimed is:

1. A tank unit, comprising:

an outer concrete tank, comprising an outer tank shell, two heads, and ring shell connections at both ends of the outer tank shell;

an inner steel tank inside the outer concrete tank, comprising an inner tank shell, two inner heads, two epitaxial structures at both ends of the inner tank shell, wherein the inner steel tank is connected to the ring shell connections of the outer concrete tank by the epitaxial structures; and an isolation layer, being formed from a gap between the outer concrete tank and the inner steel tank, wherein the gap is filled with an isolation medium, wherein the isolation medium inside the isolation layer is one or more of: an inert gas, a liquid, an inert gas with a soft solid material, or a liquid with a soft solid material, wherein a system pressure inside the isolation layer is controlled.

2. The tank unit as described in claim 1, wherein the epitaxial structure at one end of the inner steel tank is fixed onto the ring shell connection at one end of the outer concrete tank to form a fixing connection; the epitaxial structure at the other end of the inner steel tank is inset into the ring shell connection at the other end of the outer concrete tank to form a sliding connection, so that the inner steel tank slides inside the outer concrete tank along a central axis, and the outer concrete tank, the inner steel tank and the isolation layer form an integrated structure, through the fixing and sliding connections.

3. The tank unit as described in claim 1, wherein the epitaxial structure is a cylindrical epitaxial structure or a leg epitaxial structure, formed by extending from both ends of the inner tank shell respectively.

4. The tank unit as described in claim 1, wherein the inner steel tank comprises one of: at least one pair of liquid storage compartment and seawater ballast compartment in symmetrical forming as a combined tank, or at least one liquid storage compartment, wherein the liquid storage compartment and the seawater ballast compartment in the combined tank are arranged in vertical, horizontal end-to-end, or pot-in-pot positions.

5. The tank unit as described in claim 4, wherein a wall of the liquid storage compartment is a single-wall made of steel or a multi-wall, wherein the multi-wall for storing ultra-low temperature liquids comprises an inner alloy steel plate with ultra-low temperature resistance and low coefficient of linear expansion, an heat insulation material layer and an outer layer of steel plate.

6. A tank group, comprising:

two or more tank units that are closely connected in parallel or in series by group connections, wherein the tank units in the tank group are arranged vertically to become a vertical tank group or arranged horizontally to become a horizontal tank group, wherein the tank unit comprises an outer concrete tank, an inner steel tank inside the outer concrete tank and connected with the outer concrete tank via ring shell connections of the outer concrete tank and epitaxial structures of the inner steel tank, and an isolation layer in between the outer concrete tank and the inner steel tank, wherein the isolation layer is filled with an isolation medium, wherein the isolation medium inside the isolation layer is one or more of: an inert gas, a liquid, an inert gas with a soft solid material, or a liquid with a soft solid material, wherein a system pressure inside the isolation layer is controlled.

7. The tank group as described in claim 6, wherein the two or more tank units in the tank group are joined together by the group connections to form a body and closely arranged in honeycomb upright.

8. The tank group as described in claim 7, further comprising a skirt bottom compartment that embraces a lower part of the body or is attached at two lower sides of the body, wherein the skirt bottom compartment comprises one or more sub-compartments for liquid storage, seawater ballast, or fixed ballast.

9. The tank group as described in claim 6, wherein the tank group is a floating tank group that is anchored on a seabed by mooring legs, or a fixed tank group that is fixed on the seabed by one or more of: suction piles, a long pile foundation, a gravity foundation, or piles with the gravity foundation.

10. The tank group as described in claim 9, wherein the long pile foundation of the fixed tank group is a sealing steel pile foundation, wherein the sealing steel pile foundation is formed by a tubular steel pipe welded with a head at a top of a sealing steel pipe, a release valve, an air intake valve, and a water intake valve installed on the head.

11. The tank group as described in claim 10, wherein the sealing steel pile foundation is pressed into a seabed or pulled up from the seabed by a weight or buoyancy of the tank group after ballasting or de-ballasting and an operation of at least one valve, wherein at least one valve is closed and the top of a sealing steel pile is sealed when the sealing steel pile foundation is in in-place condition.

12. The tank group as described in claim 10, wherein the two or more tank units are laid horizontally and connected end-to-end in series to form a long horizontal cylinder, wherein both ends of the inner steel tank inside each tank unit are cylindrical epitaxial structures, wherein the epitaxial structures of the two or more tank units of the long horizontal cylinder are welded together and fixed to the outer concrete tanks as fixing connections, or the epitaxial structures of the two or more tank units of the long horizontal cylinder are plugged-in and joined to the outer concrete tanks as sliding connections.

13. An offshore platform, comprising:

a tank group comprising two or more tank units, wherein the tank unit comprises an outer concrete tank, an inner steel tank inside the outer concrete tank and connected with the outer concrete tank via ring shell connections of the outer concrete tank and epitaxial structures of the inner steel tank, and an isolation layer in between the outer concrete tank and the inner steel tank, wherein the isolation layer is filled with an isolation medium, wherein the isolation medium inside the isolation layer is one or more of: an inert gas, a liquid, an inert gas with a soft solid material, or a liquid with a soft solid material, wherein a system pressure inside the isolation layer is controlled;

a topsides, including facilities used for drilling, oil and gas production and transportation, utilities, or living, wherein the topsides is above water and located on a top of the tank group, and connected to the tank group by supported leg structures; and a positioning system or a foundation, wherein the positioning system is used with the offshore platform when the offshore platform is floating, and comprises one or more of: an anchor mooring system or a dynamic positioning system, wherein the foundation fixes the offshore platform on a seabed and comprises one or more of: a long pile foundation, a suction pile foundation, a sealing steel pile foundation, or a gravity foundation.

14. The offshore platform as described in claim 13, wherein the two or more tank units are joined in parallel by a concrete group connection and arranged vertically together in one layer or multi-layer concentric circles, wherein a diameter of the concrete group connection is substantially equal to a diameter of circumscribed circle projected by the joined tank units.

15. The offshore platform as described in claim 14, wherein the concrete group connection comprises a flat cylindrical connection structure at each of two ends of the two or more tank units.

16. The offshore platform as described in claim 15, wherein a bottom of a top flat cylindrical connection structure and a top of a bottom flat cylindrical connection structure protuberate up and down respectively along a vertical direction to form two conical surfaces, which reach and link with an outer surface of the joined tank units.

17. The offshore platform as described in claim 15, further comprising a skirt bottom compartment having a circular structure or a regular polygonal ring-like structure, and being fixed to a bottom flat cylindrical connection structure through multiple evenly distributed connecting structures via a radial gap in-between, wherein bottoms of the skirt bottom compartment and the flat cylindrical connection structure are in a same horizontal plane.

18. The offshore platform as described in claim 17, further comprising nicks at an inner circle of the skirt bottom compartment for mooring legs passing, or at a location that the skirt bottom compartment is disconnected to be divided into multiple sub-compartments.

19. The offshore platform as described in claim 13, further comprising a second tank group in parallel with the tank group, wherein the two tank groups are connected to each other by multiple connecting rods in the middle and plates at both ends of the tank groups to form as a complete structure.

* * * * *